US005639232A

United States Patent [19]

Bogenschutz et al.

[11] Patent Number: 5,639,232

[45] Date of Patent: Jun. 17, 1997

[54] GAS BURNER

[75] Inventors: William R. Bogenschutz, Raleigh; Phillip M. Walden, III, Angier; Fred J. Cencelewski, Fuquay-Varina, all of N.C.

[73] Assignee: Middleby Marshall Inc., Elgin, Ill.

[21] Appl. No.: 494,548

[22] Filed: Jun. 26, 1995

[51] Int. Cl.[6] ..... F23D 14/62

[52] U.S. Cl. ..... 431/354; 126/39 R; 126/39 E; 239/558; 239/559

[58] Field of Search ..... 126/39 R, 39 E, 126/39 N; 431/264, 192, 354, 266; 239/556–560, 550

[56] References Cited

U.S. PATENT DOCUMENTS

| | | | |
|---|---|---|---|
| 1,932,743 | 10/1933 | Kunz | 239/558 |
| 2,817,397 | 12/1957 | Brumbaugh | 239/559 |
| 2,860,696 | 11/1958 | Reinhart | 239/559 |
| 3,236,461 | 2/1966 | Kindl et al. | 239/559 |
| 4,518,346 | 5/1985 | Pistien | 126/39 H |
| 5,083,915 | 1/1992 | Riehl | 126/39 E |
| 5,186,158 | 2/1993 | Ferlin | 239/557 |

FOREIGN PATENT DOCUMENTS

| | | | |
|---|---|---|---|
| 14935 | 2/1977 | Japan | 239/559 |

*Primary Examiner*—James C. Yeung

*Attorney, Agent, or Firm*—David E. Bennett; Rhodes, Coats & Bennett, L.L.P.

[57] ABSTRACT

A gas burner for an open top stove is provided that generally includes three sections that can be separated from one another: a burner body, a burner head, and a drip cover. Forming the bottom of the burner and connected to a gas source is the burner body, which is generally donut-shaped and has an open-topped channel for carrying gas. Seated atop the burner body is the burner head, which is also donut-shaped and includes an open bottomed, internal gas channel that communicates with the open-topped channel of the burner body. The burner head includes two adjacent rows of flame ports that encircle an outer peripheral surface of the burner head and communicate with the internal gas channel. The flame ports of an upper of the two rows are smaller than the flame ports of the lower row. The burner head also includes a third row of flame ports encircling an upper inner peripheral surface of the burner head around the central void. Positioned atop the burner head is the removable drip cover, which overlies all of the flame ports to prevent grease and the like from dripping into and clogging the flame ports.

19 Claims, 5 Drawing Sheets

GAS BURNER

FIELD OF THE INVENTION

The present invention generally pertains to gas appliances and more particularly to the design of a gas burner for a gas appliance.

BACKGROUND OF THE INVENTION

Conventional gas burners for open-top gas appliances are designed to operate efficiently up to approximately 20,000 to 30,000 BTUs. Attempts at creating higher output burners that efficiently provide up to 40,000 BTUs of heat have not been successful. Burners which are designed to operate efficiently with an output of 20,000 to 30,000 BTUs will not operate as efficiently at higher outputs. This drop in efficiency has two undesirable results. First, lower efficiency results in an unnecessary waste of fuel which is not completely combusted. Second, the lower efficiency means that more undesirable bi-products, such as carbon monoxide, are produced during combustion.

In order to obtain acceptable efficiency levels at higher outputs, it has been necessary in the past to design the higher output burners from the ground up. Higher output burners tend to be larger than lower output burners and few components are interchangeable. The need to manufacture and maintain a separate inventory of components for high output burners results in increased costs. Furthermore, because higher output burners are often larger than lower output burners, they do not always fit into stoves designed for lower output burners.

Another limitation of conventional gas burners is the lack of an easily removable drip cover. In conventional gas burners, the drip covers are typically cast as an integral part of the burner head. This often limits access to the flame ports in the burner and creates problems when cleaning the burner. The fixed drip cover also limits the adaptability of the burner when a drip cover is not needed.

In view of these problems and disadvantages of conventional gas burners, there exists a need for a high efficiency burner that can produce up to 40,000 BTU's of heat. A need also exists for a gas burner that includes a removable drip cover that allows easier cleaning of the burner ports and that can be removed when not needed.

SUMMARY AND OBJECTS OF THE INVENTION

The present invention provides a gas burner for an open-top stove that is capable of efficiently producing up to 40,000 BTU's of heat. The burner of the present invention includes a main body formed in two sections that can be separated from one another: a burner body and a burner head. The burner body forms the bottom half of the main body and the burner head forms the top half. Together, the burner body and burner head define a gas chamber that extends 360° around the burner. The main body includes a plurality of flame ports through which gas is emitted. In the preferred embodiment of the invention, the flame ports are arranged in two rows which extend circumferentially around the burner. The flame ports in the lower row have a larger bore size than the flame ports in the upper row. An equal number of flame ports are in each row with the flame ports in the upper and lower rows being staggered with respect to one another.

This arrangement results in flames from the lower, larger flame ports combusting most of the ambient, secondary air around the burner, while allowing flames from the smaller, upper flame ports to combust mainly gas and air delivered from the internal gas channel within the burner. Therefore, the burner of the invention burns with much hotter, harder flames than conventional burners. A third row of flame ports is formed in the inner bevel surface to supplement the two outer rows of flame ports.

In another aspect of the present invention, the burner of the present invention includes a removable drip cover which overlies the flame ports to prevent grease and the like from clogging them. To center the drip cover over the burner head and prevent the drip cover from sliding out of place, the burner head includes nubs on its top surface that engage corresponding indentations in the bottom surface of the drip cover.

Accordingly, in view of the above, an object of the present invention is to provide a stove-top gas burner that efficiently produces up to 40,000 BTU's of heat.

Another object of the present invention is to provide a stove-top gas burner that includes a removable drip cover that allows easier cleaning of the burner and that can be removed when not needed.

Other objects and advantages of the present invention will become apparent and obvious from a study of the following description and the accompanying drawings, which are merely illustrative of such invention.

DETAILED DESCRIPTION OF THE INVENTION

Figure 1:
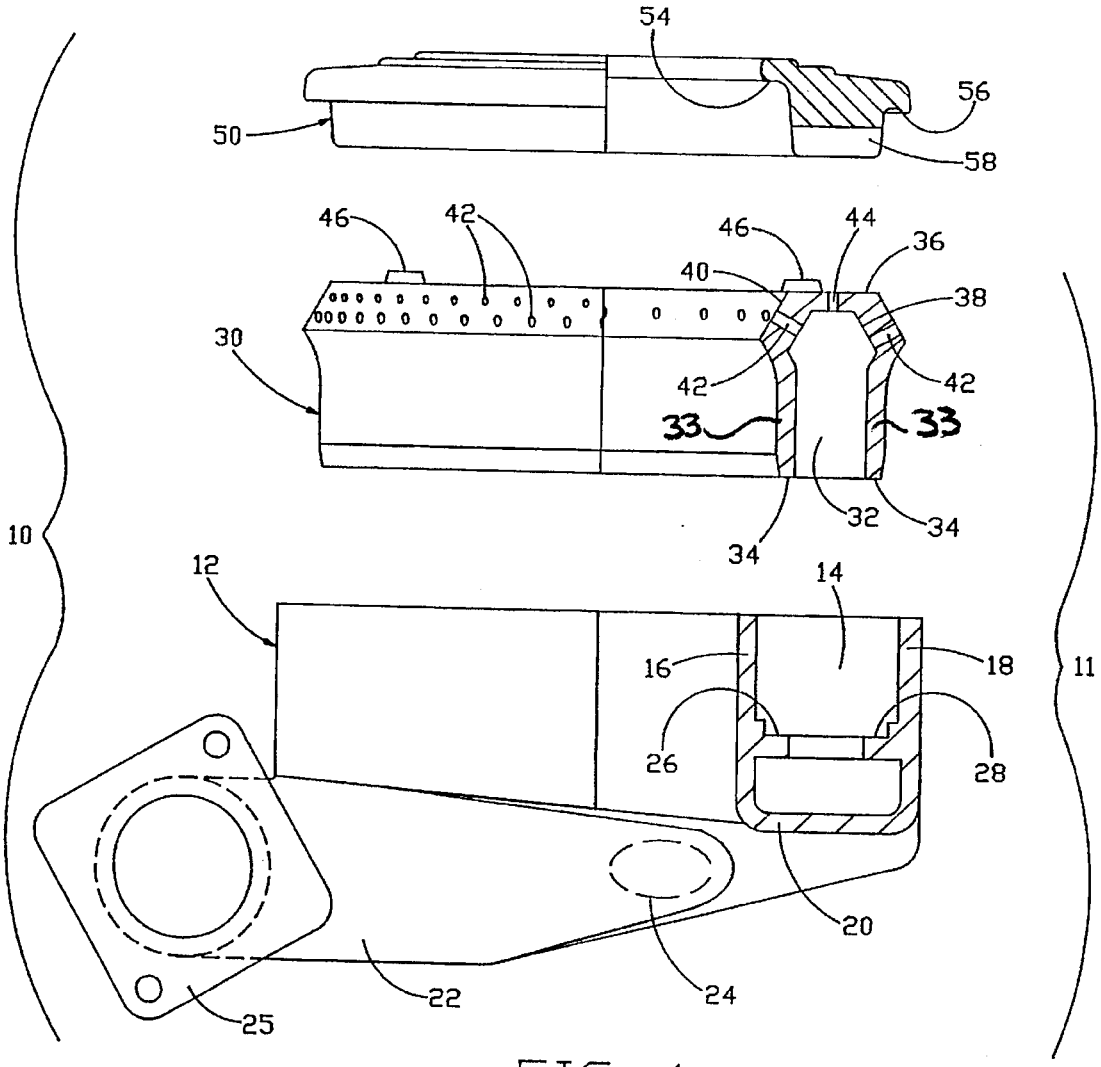
FIG. 1 is an exploded elevation view of the gas burner of the present invention with a quarter-section of the burner removed.

With further reference to the drawings, the open-top gas burner of the invention is shown therein and is generally indicated by the numeral 10. As seen in the drawings, the gas burner 10 of the invention is preferably circular and generally donut-shaped, having a central axial void. The burner 10 has a main body 11 and a drip cover 50. The main body 11 is formed in two sections that can be separated from one another: a burner body 12 and a burner head 30. Together, the burner body 12 and the burner head 30 define an internal gas chamber that extends 360° around the burner 10. A gas/air mixture enters the burner 10 through an inlet port 24 on one side of the burner body 12. An inlet 22, which is integrally formed with the burner body 12 directs the gas/air mixture through the inlet port 24. Gas exits the burner 10 through a series of flame ports 42 which are formed in the burner head 30. The gas/air mixture is ignited as it exits through the flame ports 42. The drip cover 50 rests on top of the burner head 30 and overhangs the flame ports 42 to prevent grease and other drippings from clogging the flame ports 42.

Figure 2:
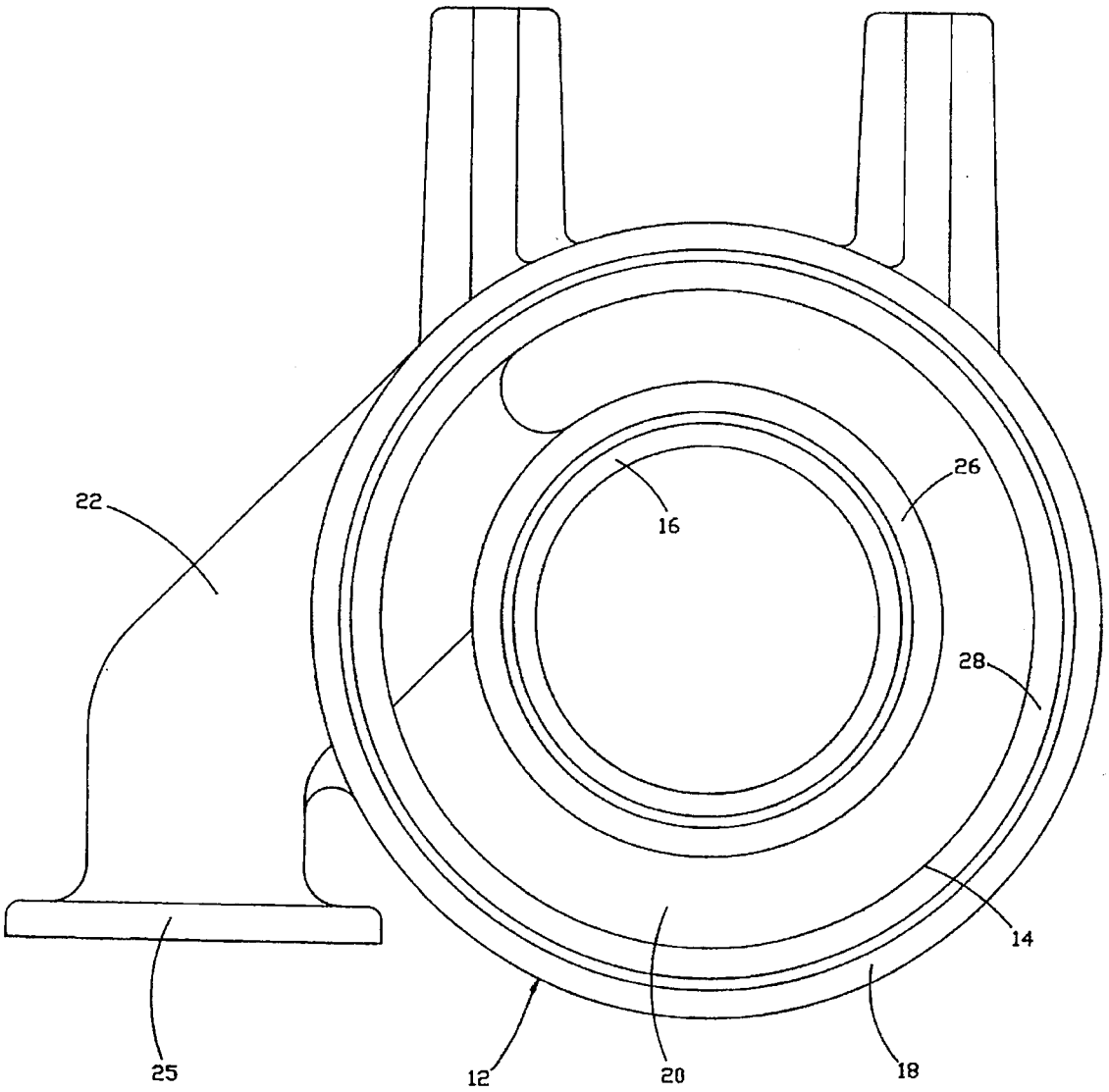
FIG. 2 is a top plan view of the burner body.

Referring now to FIG. 2, the burner body 12 is shown in more detail. The burner body 12 has a generally donut-shaped configuration when viewed from the top as shown in FIG. 2. The burner body 12 has a u-shaped cross-section which forms an open top channel 14. The channel 14 of the burner body 12 includes an inner wall 16, an outer wall 18, and a bottom surface 20.

The burner body 12 is connected to a venturi then to a gas valve on a manifold (not shown). The inlet 22 has a mounting flange 25 for connecting the burner 10 to the manifold. The inlet 22 delivers gas to the burner body 12 through an inlet port 24. The bottom 20 of the burner body 12 extends in continuous, circular fashion throughout the burner body. The bottom 20 preferably ascends over approximately 315° around the burner body 12 from the inlet port 24. This rise in the bottom 20 of the burner body 12 ensures an even distribution of the gas/air mixture around the burner 10.

To support the burner head 30 inside the burner body 12, two annular ledges 26 and 28, which are best seen in FIG. 1, extend around the gas channel 14 of the burner body 12. These two ledges 26 and 28 are preferably coplanar. As will be explained further below, the top surfaces of the circular ledges 26 and 28 of the burner body 12 are preferably machined smooth.

Figure 3:
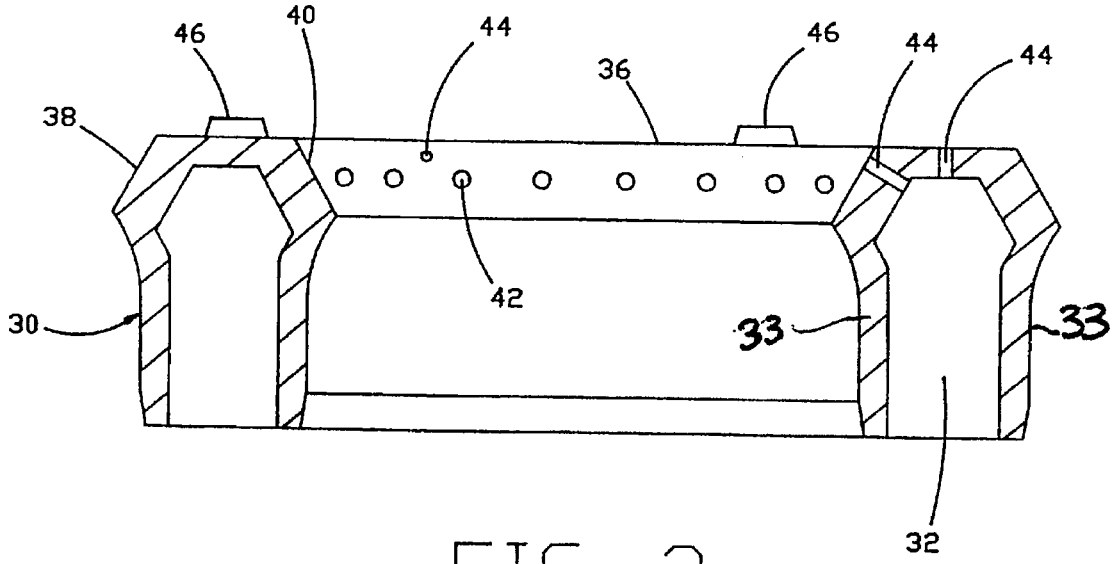
FIG. 3 is a half-section view of the burner head.
Figure 4:
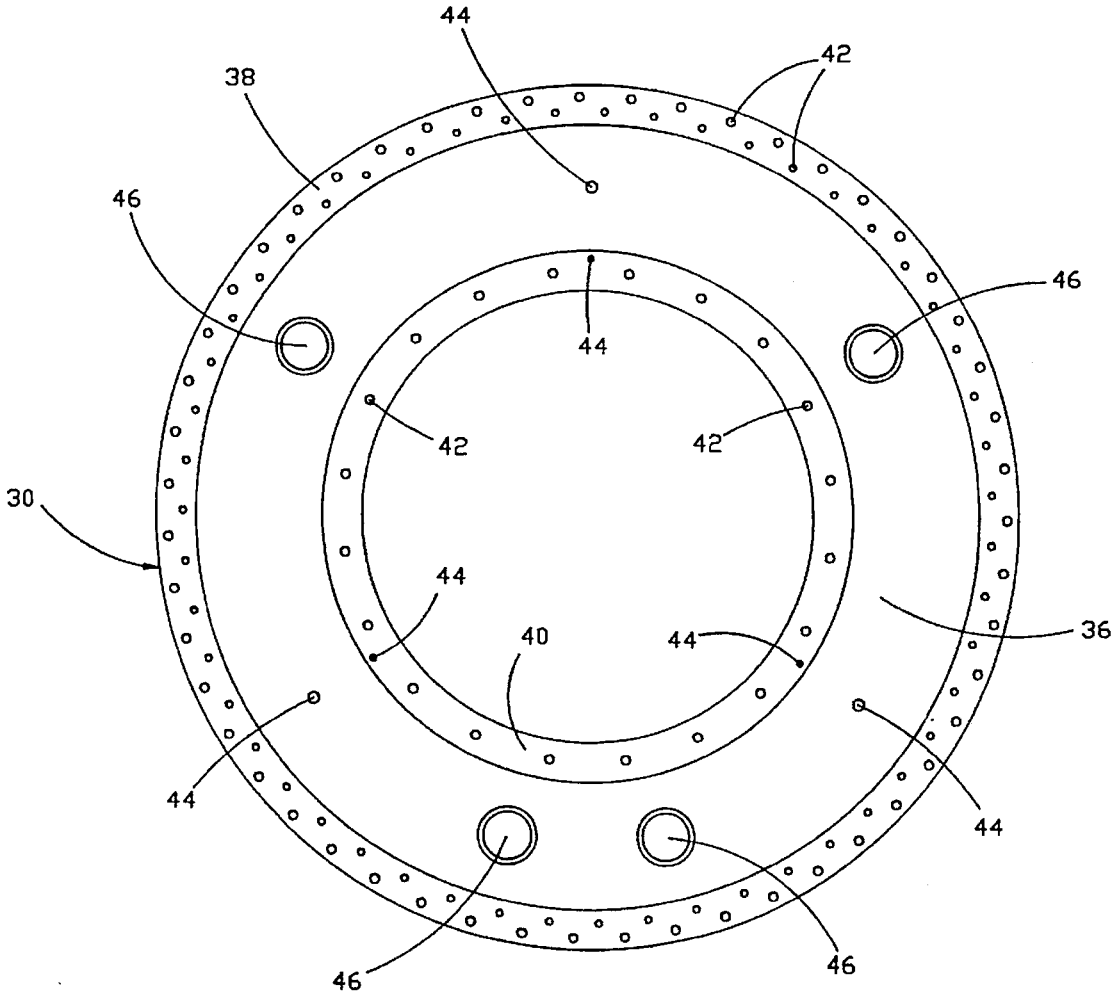
FIG. 4 is a top plan view of the burner head.

Referring now to FIGS. 3 and 4, the burner head 30 is shown. The burner head 30 also has a donut-shape when viewed in plan. When viewed in cross-section, the burner head 30 is u-shaped and forms a channel 32 having an open bottom. The channel 32 of the burner head 30 has two side walls 33. The bottom edges 34 of the side walls 33 are ground flat so as to rest on the ledges 26 and 28 in the burner body 12. Preferably, the bottom edges 34 of the burner head 30 are machined smooth to seat tightly against the inner and outer ledges 26 and 28 of the burner body 12 when the burner head 30 is seated in the burner body 12. This tight seal prevents unwanted gas leakage from the gas chamber of the burner 10.

The burner head 30 includes a flat, top surface 36 disposed between two angled, bevel surfaces 38 and 40. The outer bevel surface 38 angles downwardly from the flat, top surface 36 away from the center of the burner head 30. The inner bevel surface 40 angles downwardly from the flat, top surface 40 into the central void. Preferably, both the inner and the outer bevel surfaces 36 and 38 are angled approximately 30° from vertical.

A series of flame ports 42 are formed in the bevel surfaces 38 and 40. On the outer bevel surface 38, the flame ports 42 are arranged in two rows. Both rows include an equal number of flame ports 42 with the flame ports 42 in the upper row being disposed between the flame ports 42 in the lower row. The flame ports 42 of the top row have smaller diameters than the flame ports of the bottom row. For example, in one embodiment of the burner 10 of the invention, the bottom flame ports 42 have a diameter of 0.104 inches, and the top flame ports 42 have a diameter of 0.078 inches. One reason for this differential is that the flame emitted from the bottom flame ports 42 consumes most of the secondary air around the burner 10. Because there is little secondary air available for combustion for the upper row, those flame ports 42 have a smaller diameter to restrict the gas flow through the upper row of the flame ports 42. As a result of this port arrangement, the burner 10 of the invention produces much hotter, harder flames than conventional open-top burners.

A single row of flame ports 42 are formed on the inner bevel surface 40. Preferably, the flame ports 42 on the inner bevel surface 40 are the same diameter as the flame ports 42 in the bottom row on the outer bevel surface 38.

The burner head 30 also includes a number of charge ports 44 which facilitate the ignition of the gas emitted through the flame ports 42 on the inner bevel surface 40. The burner 10 is mounted in the stove such that the pilot of the stove ignites the gas emitted through the flame ports 42 on the bottom row of the outer bevel surface 38. The flame from the bottom row of flame ports 42 in turn ignites the gas emitted through the top row of flame ports 42 on the outer bevel surface 38. To insure that the gas emitted through the flame ports 42 on the inner bevel surface 40 is ignited, the charge ports 44 are provided to carry the flame to the inside of the burner 10. Three charge ports 44 are formed in the top surface 36 of the burner head 30. Three additional charge ports 44 are formed on the inner bevel surface 40 above the row of flame ports 42 and adjacent to the charge ports 44 on the top surface 36. The charge ports 44 are sufficiently close to one another, and to the flame ports 42 on the inner and outer bevel surfaces 38 and 40 to insure ignition of the inner flame ports 42.

Figure 5:
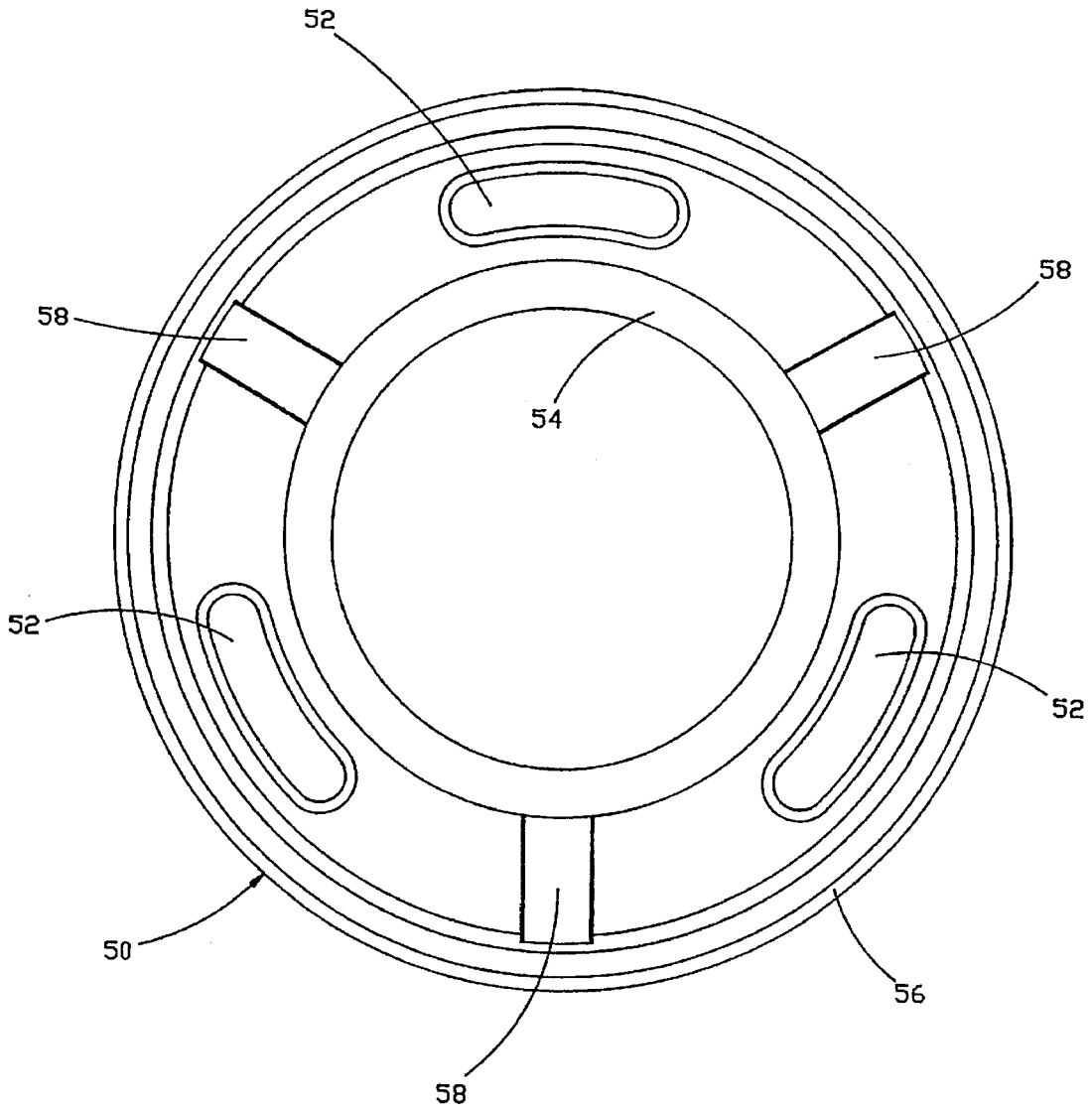
FIG. 5 is a bottom plan view of the drip cover.

Referring now to FIG. 5, a bottom view of the drip cover 50 is shown. The drip cover 50 is a solid ring-shaped member which is designed to rest on the top surface 36 of the burner head 30. To center the removable drip cover 50 over the burner head 30 and prevent the drip cover 50 from sliding out of place, the burner head 30 includes a series of nubs 46 on its top surface 36 that engage corresponding grooves 52 in the bottom surface of the drip cover 50. In the depicted embodiment, there are four nubs 46 on the top surface 36 of the burner head 30; however, more or less would also suffice. Preferably, the grooves 52 have an elongated arcuate shape to allow for some rotational movement of the removable drip cover 50 when it is positioned atop the burner head 30. As with the nubs 46, there are three arcuate channels 52 in the depicted embodiment, although more or less could be also be provided. To accommodate the charge ports 44 in the burner head 30, the drip cover 50 also includes three radial channels 58 in the bottom surface of the drip cover 50. The radial channels 58 in the drip cover 50 overlie the charge ports 44 in the top surface 36 of the burner head 30. The radial channels 58 allow the flame to pass between the drip cover 50 and the burner head 30 when the burner is ignited.

The removable drip cover 50 includes both inner and outer overhangs 54 and 56 which extend overtop of flame ports 42 in the burner head 30 to prevent any grease or other foreign matter from dripping into and clogging the flame ports 42. However, if desired for a particular cooking situation, the drip cover 50 can be removed entirely.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A gas burner for an open-top appliance, comprising:

a) a donut-shaped burner body having an inlet connected to a gas source, said burner body having a bottom surface that spirals upwardly from said inlet;

b) a donut-shaped burner head disposed on top of said burner body, wherein said burner body and said burner head define an internal gas chamber having a gradually reducing cross section;

c) first and second rows of flame ports formed in an outer peripheral surface of said burner head, wherein said second row of flame ports are interleaved between and disposed above said first row of flame ports, and wherein said second row of flame ports have a smaller diameter than the flame ports in said first row;

d) a third row of flame ports formed in an inner peripheral surface of said burner head; and e) at least one charge port formed in said burner head and communicating with said internal gas chamber for carrying a flame from the rows of flame ports in the first peripheral surface to the row of flame ports in the second peripheral surface.

2. The gas burner of claim 1 further comprising a removable drip cover seated atop the burner head and overlying the rows of flame ports and the at least one charge port.

3. The gas burner of claim 1 wherein said burner head includes a generally flat top surface disposed between inner and outer angled, bevel surfaces.

4. The gas burner of claim 3 wherein the first and second rows of flame ports are disposed in said outer bevel surface and wherein the third row of flame ports is disposed in said inner bevel surface.

5. The gas burner of claim 4 wherein the at least one charge port includes a plurality of charge ports disposed in said flat top surface.

6. The gas burner of claim 1 wherein the removable drip cover includes at least one radial channel formed in a bottom surface thereof, said at least one radial channel overlying said at least one charge port to allow the flame to pass from the rows of flame ports in the first peripheral surface to the row of flame ports in the second peripheral surface.

7. The gas burner of claim 1, wherein the flame ports in said second row have a smaller diameter than the flame ports in said first row, the ratio of the diameter of the flame ports in said second row to the diameter of the flame ports in said first row being approximately 0.078 to 0.104.

8. A gas burner for an open-top appliance comprising:

a) a donut-shaped burner body having an inlet connected to a gas source, said burner body having a bottom surface that spirals upwardly from said inlet;

b) a donut-shaped burner head disposed on top of said burner body, wherein said burner body and said burner head define an internal gas chamber having a gradually reducing cross section;

c) first and second rows of flame ports formed in an outer peripheral surface of said burner head, wherein said second row of flame ports are interleaved between and disposed above said first row of flame ports, and wherein said second row of flame ports have a smaller diameter than the flame ports in said first row; and d) a third row of flame ports formed in an inner peripheral surface of said burner head.

9. The gas burner of claim 8 further comprising a removable drip cover positioned on top of the burner head and overlying the flame ports and the at least one charge port to protect the flame ports and the at least one charge port from grease and other drippings.

10. The gas burner of claim 9 wherein the burner head further includes a plurality of convex nubs on a top surface of the burner head, and wherein the removable drip cover includes in a bottom surface thereof a plurality of concave indentations for engaging the convex nubs when the drip cover is positioned atop the burner head.

11. The gas burner of claim 10 wherein the concave indentations in the bottom surface of the removable drip cover form elongated arcuate channels.

12. The gas burner of claim 9 wherein the removable drip cover includes at least one radial channel formed in a bottom surface thereof, said at least one radial channel overlying said at least one charge port.

13. The gas burner of claim 12 wherein said at least one charge port includes a plurality of charge ports formed in a top surface of said burner head, and wherein said at least one radial channel includes a plurality of radial channels formed in the bottom surface of the removable drip cover.

14. The gas burner of claim 8 wherein the burner head is donut-shaped, having a central void therethrough and generally flat, ring-shaped top surface disposed between inner and outer angled, beveled surfaces, wherein the burner head includes an inner row of flame ports encircling the inner angled bevel surface of the burner head and surrounding the central void, each flame port of the inner row communicating with the gas chamber, and wherein the burner head includes at least one outer row of flame ports encircling the outer angled bevel surface of the burner head, each flame port of the at lest one outer row communicating with the gas chamber.

15. The gas burner of claim 14 wherein said at least one charge port includes a plurality of charge ports disposed in the flat top surface between the inner and outer angled bevel surfaces.

16. The gas burner of claim 14, wherein said at least one charge port is disposed in the flat top surface between the inner and outer angle bevel surfaces, said at least one charge port for carrying the gas flame from the flame ports in the outer angle bevel surface to the flame ports in the inner angle bevel surface.

17. A gas burner, comprising:

a) a burner head connected to a gas source and including an internal gas chamber, the burner head including:

i) a first row of flame ports encircling an outer peripheral surface of the burner head, wherein each flame port of the first row communicates with the gas chamber, ii) a second row of flame ports encircling the outer peripheral surface of the burner head adjacent to and above the first row of flame ports, wherein each flame port of the second row communicates with the gas chamber, iii) a third row of flame ports encircling an inner peripheral surface of the burner head, wherein each flame port of the third row communicates with the gas chamber, and iv) a plurality of charge ports disposed in a top surface of the burner head between the inner and outer peripheral surfaces, wherein each charge port communicates with the gas chamber, said charge ports for carrying a flame from the flame ports encircling the outer peripheral surface to the flame ports encircling the inner peripheral surface; and b) a removable drip cover seated atop the burner head and overlying the first and second rows of flame ports and the charge ports, wherein the removable drip cover includes a plurality of radial channels in a bottom surface of the removable drip cover, said radial channels overlying the charge ports in the top surface of the burner head to permit the flame to pass between the removable drip cover and the burner head when the burner is ignited.

18. The gas burner of claim 17 wherein the burner head is donut-shaped, having a central void therethrough and a ring-shaped top surface, and wherein the removable drip cover is also ring-shaped.

19. The gas burner of claim 17 wherein the flame ports in said second row have a smaller diameter than the flame ports in said first row, the ratio of the diameter of the flame ports in said second row to the diameter of the flame ports in said first row being approximately 0.078 to 0.104.

* * * * *